US012637853B2

(12) United States Patent
De Gasperis et al.

(10) Patent No.: US 12,637,853 B2
(45) Date of Patent: May 26, 2026

(54) STORMWATER MANAGEMENT SYSTEM

(71) Applicant: Con-Cast Pipe Inc., Puslinch (CA)

(72) Inventors: Adam De Gasperis, Concord (CA); Frank De Gasperis, Concord (CA); Greg Dziewiecki, Concord (CA); Eric Cumsikey, Concord (CA)

(73) Assignee: Con-Cast Pipe Inc., Puslinch (CA)

( * ) Notice: Subject to any disclaimer, the term of this patent is extended or adjusted under 35 U.S.C. 154(b) by 74 days.

(21) Appl. No.: 18/624,765

(22) Filed: Apr. 2, 2024

(65) Prior Publication Data

US 2025/0257557 A1 Aug. 14, 2025

(30) Foreign Application Priority Data

Feb. 14, 2024 (CA) ..... 3229204

(51) Int. Cl.
*E03F 1/00* (2006.01)
*E02B 11/00* (2006.01)

(52) U.S. Cl.
CPC ..... *E03F 1/005* (2013.01); *E02B 11/00* (2013.01)

(58) Field of Classification Search
CPC ..... E03F 1/003; E03F 1/005; E02B 11/00; E02B 11/005
See application file for complete search history.

(56) References Cited

U.S. PATENT DOCUMENTS

| | | | | |
|---|---|---|---|---|
| 7,080,480 | B2 * | 7/2006 | Urban | E01C 9/005 210/170.03 |
| 7,621,695 | B2 * | 11/2009 | Smith | E03F 1/005 210/170.03 |
| 8,360,100 | B2 * | 1/2013 | Burkhart, Sr. | E03F 1/003 210/170.03 |
| 9,506,235 | B2 * | 11/2016 | Adams | E03F 1/005 |
| 9,775,303 | B2 * | 10/2017 | Ray | E03F 1/002 |
| 10,435,880 | B1 * | 10/2019 | Elliott, Jr. | E01C 11/226 |
| 10,612,227 | B2 * | 4/2020 | Elliott, Jr. | E03F 1/005 |
| 10,808,390 | B2 * | 10/2020 | Van Der Scheer | E03F 1/005 |
| 10,808,391 | B2 * | 10/2020 | Bhatia | E02B 11/005 |
| 10,808,392 | B2 * | 10/2020 | Bhatia | E03F 1/005 |
| 11,492,793 | B2 * | 11/2022 | Kulick, III | E03F 1/002 |
| 12,006,676 | B2 * | 6/2024 | Messerschmidt | E03B 3/03 |
| 2012/0255624 | A1 * | 10/2012 | Canney | E02B 11/005 137/315.01 |
| 2014/0105684 | A1 * | 4/2014 | Allard | E02B 11/00 405/52 |
| 2018/0030712 | A1 * | 2/2018 | Kent | E03F 1/005 |
| 2020/0011048 | A1 * | 1/2020 | Kent | E03B 11/14 |
| 2020/0248442 | A1 * | 8/2020 | Yuki | E03F 1/005 |

(Continued)

FOREIGN PATENT DOCUMENTS

| | | | | |
|---|---|---|---|---|
| CN | 110382796 B | * | 6/2023 | E03F 1/005 |
| ES | 2366981 T3 | * | 10/2011 | E03F 5/101 |
| KR | 101665326 B1 | * | 10/2016 | E01C 5/00 |

*Primary Examiner* — Frederick L Lagman
(74) *Attorney, Agent, or Firm* — Carlson, Gaskey & Olds, P.C.

(57) ABSTRACT

There is provided a stormwater system which includes plastic stormwater elements surrounded by a concrete perimeter channel. Distribution and low flow channels may extend perpendicular to each other, and through the stormwater elements, connected to the perimeter channel. Manholes and access shafts allow for access to the entire system for inspection and cleaning.

10 Claims, 7 Drawing Sheets

(56) References Cited

U.S. PATENT DOCUMENTS

| | | | | |
|---|---|---|---|---|
| 2023/0167635 | A1* | 6/2023 | Holbrook | E03F 1/005<br>210/170.03 |
| 2023/0175246 | A1* | 6/2023 | Miller | E03F 1/005<br>405/36 |
| 2023/0212848 | A1* | 7/2023 | Vitarelli | E03F 1/005<br>405/52 |
| 2023/0220658 | A1* | 7/2023 | Pegoraro | E03F 5/06<br>405/36 |
| 2023/0243143 | A1* | 8/2023 | Miller | E03F 1/005<br>405/52 |

* cited by examiner

STORMWATER MANAGEMENT SYSTEM

FIELD OF THE DISCLOSURE

The present disclosure relates to a stormwater management system.

BACKGROUND

The background description includes information that may be useful in understanding the present inventive subject matter. It is not an admission that any of the information provided herein is prior art or applicant admitted prior art, or relevant to the presently claimed inventive subject matter, or that any publication specifically or implicitly referenced is prior art or applicant admitted prior art.

Water—particularly drinking water—is a priceless resource which should be treated responsibly and used sparingly. It is therefore wise to collect, store and use stormwater if the water must not necessarily be suitable for drinking purposes, instead of allowing the water to infiltrate into the soil unused or diverting it into the sewer system. There are many examples: irrigation for greens, car wash, use in toilets, etc.

Water is diverted into a waterproof storage/infiltration system and can be supplied for use via a pumping system.

Stormwater harvesting systems provide water for different domestic and industrial water uses. They comprise a watertight retaining element, an inlet with upstream stormwater treatment system, a pump shaft and a system control.

Every subdivision that is constructed requires a form of stormwater management, whether it be an open-faced pond/catchment area, or a subsurface facility, it is a requirement in order for subdivisions to come into existence and function with proper drainage.

All catch basins within the subdivision collect stormwater from the roads during rain events and allow for both sediment and velocity control before discharging into the natural environment, or recharging back into the soil profiles beneath the system itself.

Large amounts of stormwater can reduce the performance of wastewater treatment systems. Infiltrating unpolluted stormwater nearby has therefore several advantages. A constant growth in built-up areas and increase in impervious surfaces prevent natural infiltration of stormwater into the soil. Special infiltration systems are used in order to discharge it to the water cycle. In addition to infiltration using pipe swales, increasingly more storage/infiltration systems are being built.

If subsoil conditions are unfavourable to infiltration, the goal is to retain the stormwater and ensure a retarded, time-lagged discharge. Exposure to impulsive stress can be eliminated or reduced in sewer networks, wastewater treatment systems and waterbodies.

Stormwater retention systems retard the infiltration of stormwater. They are comprised of a watertight retaining element, an inlet and a vortex outlet.

The stormwater distributes evenly in the system where it can be stored and is then discharged in a controlled manner through throttle shafts. If infiltration must be avoided or to prevent unintended discharge of groundwater or strata water (e.g., in case of contaminated soil), it is necessary to waterproof the retention system.

Stormwater runoff from impervious surfaces that cannot infiltrate naturally leads to peak loads in sewer systems. Stormwater retention facilities collect stormwater in an underground storage tank and discharge it in a retarded manner but continuously. Their very short construction times make storage/infiltration systems an inexpensive alternative to conventional retention facilities such as retention channels or underground concrete tanks.

Pipe and gravel swales only use approximately 30% of their volume to store water. Therefore, three times the required water storage volume must be provided by excavation. This requires lots of space which is frequently not available in urban areas.

GreenStorm™ ST is one example of a modular system of plastic tanks to be installed underground (storage/infiltration modules) in which water is collected and stored. Storage/infiltration systems temporarily collect stormwater and discharge it later. In addition to infiltration using underdrained swale systems, pipe swales, and gravel swales common in the past, increasingly more storage/infiltration systems are being built today. With a storage volume of more than 96%, the GreenStorm system stores over two times as much water as gravel swales.

The storage space of the storage/infiltration system consists of numerous GreenStorm ST modules which can be combined three-dimensionally to form large systems.

The advantage of this method is that the void ratio is over two times larger in these infiltration systems than in gravel swales which saves space and excavation work.

One downside to systems such as GreenStorm is that they cannot be constructed overly deep, partially due to the large void ratio discussed above. With the plastic modules and large void ratios, GreenStorm is susceptible to large lateral forces that increase as the stormwater system is placed deeper into the earth.

Another downside is the difficulty to maintain and inspect such a facility. In the GreenStorm system the only means for inspection from the ground surface is through certain specific access points.

Thus, there remains a need to improve upon plastic facilities such as GreenStorm ST, to increase the accessibility for inspection and cleaning, while increasing the stability of the stormwater system against lateral forces, and thus increasing the possible depth of the stormwater system.

In some embodiments, the numbers expressing quantities of ingredients, properties such as concentration, reaction conditions, and so forth, used to describe and claim certain embodiments of the inventive subject matter are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the inventive subject matter are approximations, the numerical values set forth in the specific examples are reported as precisely as practicable. The numerical values presented in some embodiments of the inventive subject matter may contain certain errors necessarily resulting from the standard deviation found in their respective testing measurements.

Unless the context dictates the contrary, all ranges set forth herein should be interpreted as being inclusive of their endpoints and open-ended ranges should be interpreted to include only commercially practical values. Similarly, all lists of values should be considered as inclusive of intermediate values unless the context indicates the contrary.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

The recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g., "such as") provided with respect to certain embodiments herein is intended merely to better illuminate the inventive subject matter and does not pose a limitation on the scope of the inventive subject matter otherwise claimed. No language in the specification should be construed as indicating any non-claimed element essential to the practice of the inventive subject matter.

Groupings of alternative elements or embodiments of the inventive subject matter disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

SUMMARY

The present disclosure is directed to a stormwater system, comprising: a plurality of plastic modular elements, each modular element including four quadrants, each quadrant having multiple upwardly-extending supports, and a pair of inspection channels arranged in a cross-shape separating the four quadrants; a distribution channel separating two or more of the plurality of modular elements; a low flow channel intersecting the distribution channel perpendicularly, and separating two or more of the plurality of modular elements; and a concrete perimeter channel surrounding the plurality of plastic modular elements and wherein each end of the distribution channel and each end of the low flow channel extend to the perimeter channel.

In a preferred embodiment at least one of the distribution channel and the low flow channel is made of concrete.

In one embodiment at least one of the perimeter channel, the distribution channel, and the low flow channel is positioned deeper into the ground than the modular elements, thus allowing water and sediment to collect.

One embodiment further comprises a center access manhole located at the center of the system where the distribution channel intersects with the low flow channel.

In another embodiment, the system comprises additional perimeter manholes at the intersections of the perimeter channel and each end of the low flow channel.

In one embodiment at least one of the perimeter channel and the distribution channel includes at least one cored out section, allowing access to the modular elements.

In one embodiment at least one additional distribution channel and/or at least one additional low flow channel extends perpendicular to the distribution channel and between at least two of the plurality of modular elements.

Another embodiment is directed to a stormwater system, comprising: at least four plastic stormwater sections, each section including at least one inspection channel; a distribution channel separating two or more of the stormwater sections; a low flow channel intersecting the distribution channel perpendicularly, and separating two or more of the stormwater sections; and a concrete perimeter channel surrounding the plurality of plastic stormwater sections; wherein each end of the distribution channel and each end of the low flow channel extend to the perimeter channel.

An additional embodiment is directed to a stormwater system, comprising: a plurality of plastic modular elements, each modular element including: four quadrants, each quadrant having multiple upwardly-extending supports; and a pair of inspection channels arranged in a cross-shape separating the four quadrants; a concrete perimeter channel surrounding the plurality of plastic modular elements.

Various objects, features, aspects and advantages of the inventive subject matter will become more apparent from the following detailed description of preferred embodiments, along with the accompanying drawing figures in which like numerals represent like components.

BRIEF DESCRIPTION OF THE DRAWINGS

The present disclosure will be better understood having regard to the drawings in which.

DETAILED DESCRIPTION OF THE DRAWINGS

As can be seen in Figures, the present system 10 includes, in one embodiment, a plurality of plastic modular elements 20, such as the GreenStorm ST, where in a preferred embodiment, each of the modular elements 20 is made of polypropylene.

Figure 1:
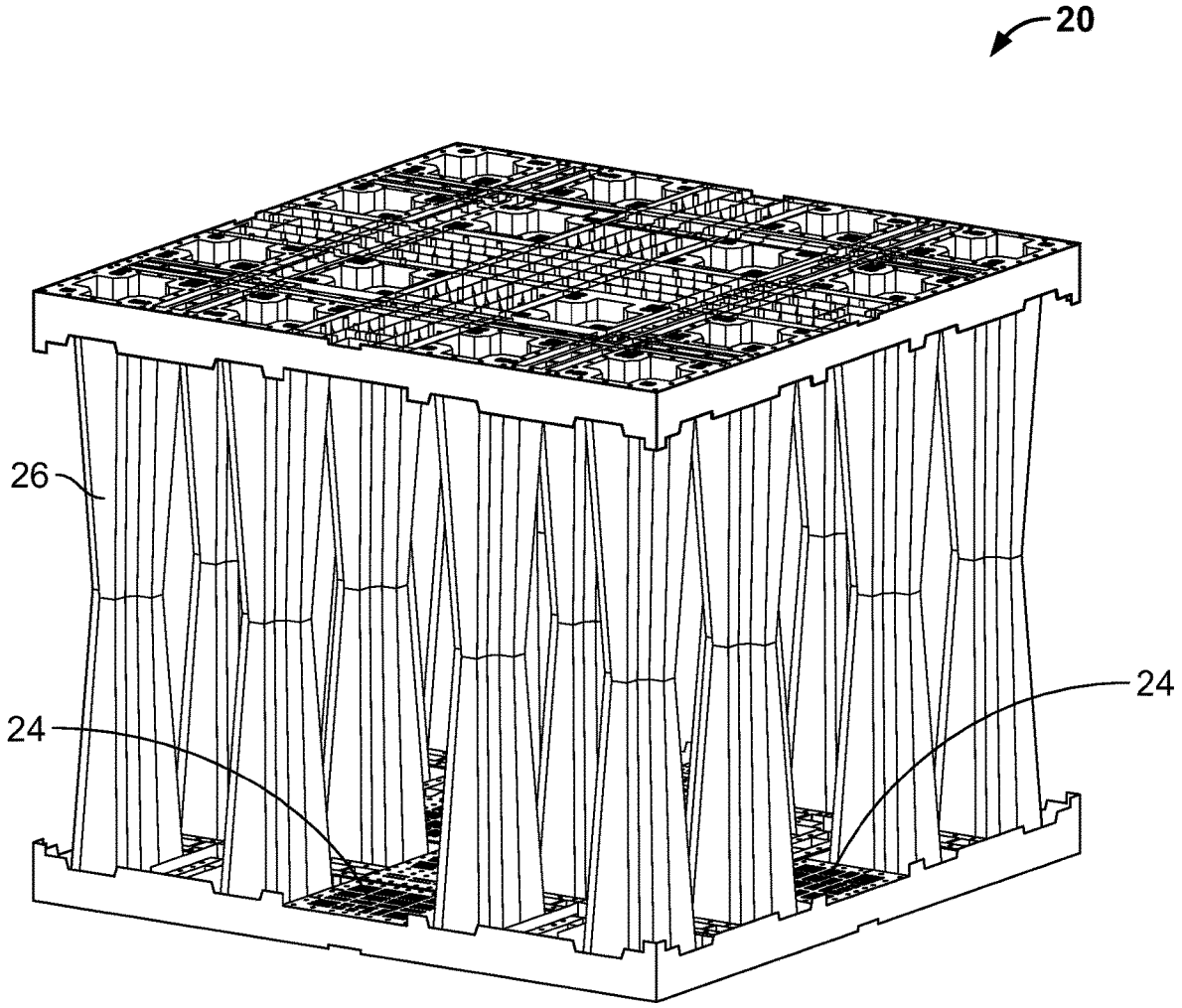
FIG. 1 shows one embodiment of the modular element of the present invention.
Figure 2:
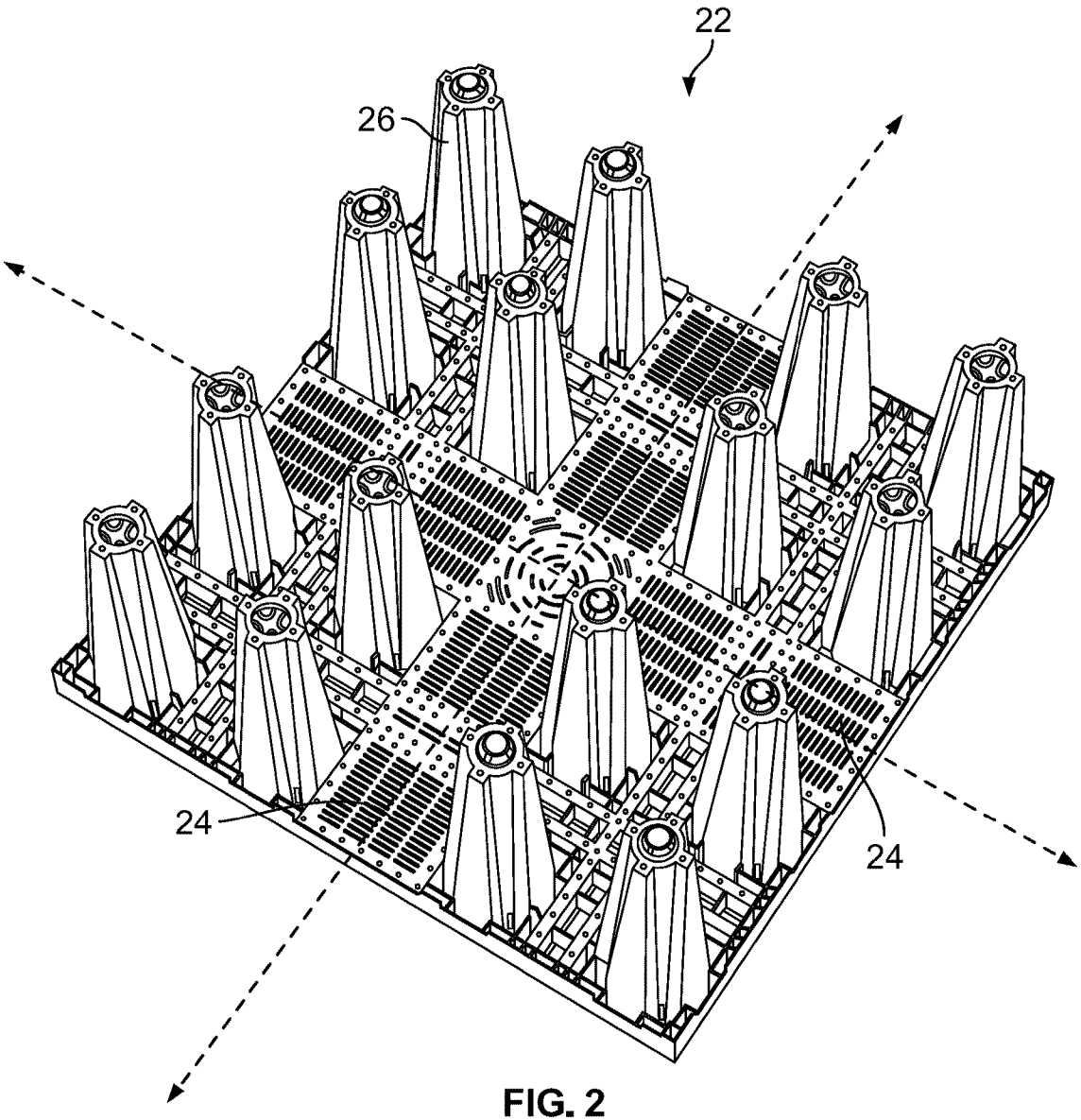
FIG. 2 shows a perspective view of a portion of the modular element.

As seen in FIGS. 1 and 2, each modular element 20 is preferably divided into four quadrants, separated by a pair of cross-shaped inspection tunnels 24 thus allowing the storage/infiltration system 10 to be camera-accessible and flushable in two axes and thus in four dimensions. The special and open design of each of the inspection tunnels 24 allows for a complete and unobstructed view thereof. In one embodiment the inspection is done using Closed Circuit Television (CCTV).

In one embodiment, in each quadrant of each modular element 20 are multiple upwardly extending supports 26. In the embodiment shown in FIGS. 1 and 2, there are four upwardly extending supports 26 in each quadrant. As previously stated, in one preferred embodiment, the system 10 uses GreenStorm ST elements, although any type of plastic stormwater arrangement could be used within the present system 10.

Figure 10:
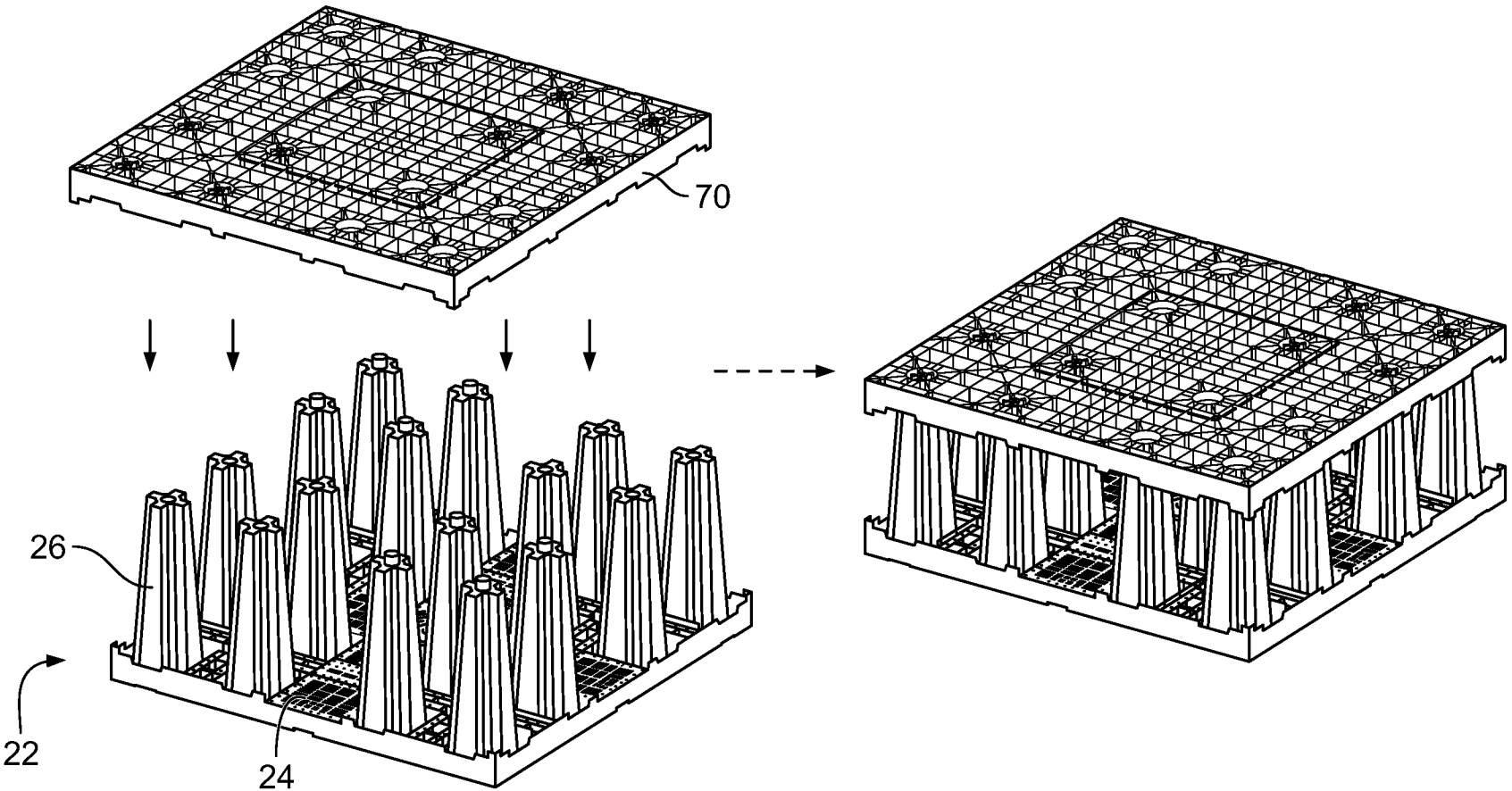
FIG. 10 shows an alternate embodiment of the modular element, having only a singular modular base.

As is known with the GreenStorm modular elements, each modular element 20 includes a modular base 22, which can be seen in FIG. 2, and includes the inspection tunnels 24 and upwardly extending supports 26. Further, a second modular base 22 can be inverted and placed on top of the original base. This embodiment can be seen in FIG. 1. Alternatively, the singular modular base 22 can have a plastic roof slab 70 placed on top. This arrangement is seen in FIG. 10, and could also be used within the present system 10.

In a preferred embodiment, a plurality of the modular elements 20 are surrounded by a concrete perimeter channel 30. This concrete perimeter channel 30 allows for increased support against lateral forces. In one embodiment, the perimeter channel 30 includes concrete box culverts.

In one embodiment, a distribution channel 32 passes through the modular elements 20, from one portion of the perimeter channel 30 to an opposing portion of the perimeter channel 30. Similarly, a low flow channel 34 also travels from one portion of the perimeter channel 30 to an opposing portion, with the low flow channel 34 intersecting the distribution channel 32 perpendicularly. This can be best seen in one embodiment shown in FIG. 3.

In one embodiment, the distribution channel 32 includes end caps at each end, which sealingly engages the perimeter channel 30 such that no water passes between the distribution channel 32 and the perimeter channel 30.

In another embodiment, the distribution channel 32 connects to the perimeter channel 30, allowing passage from one channel to the other.

Figure 3:
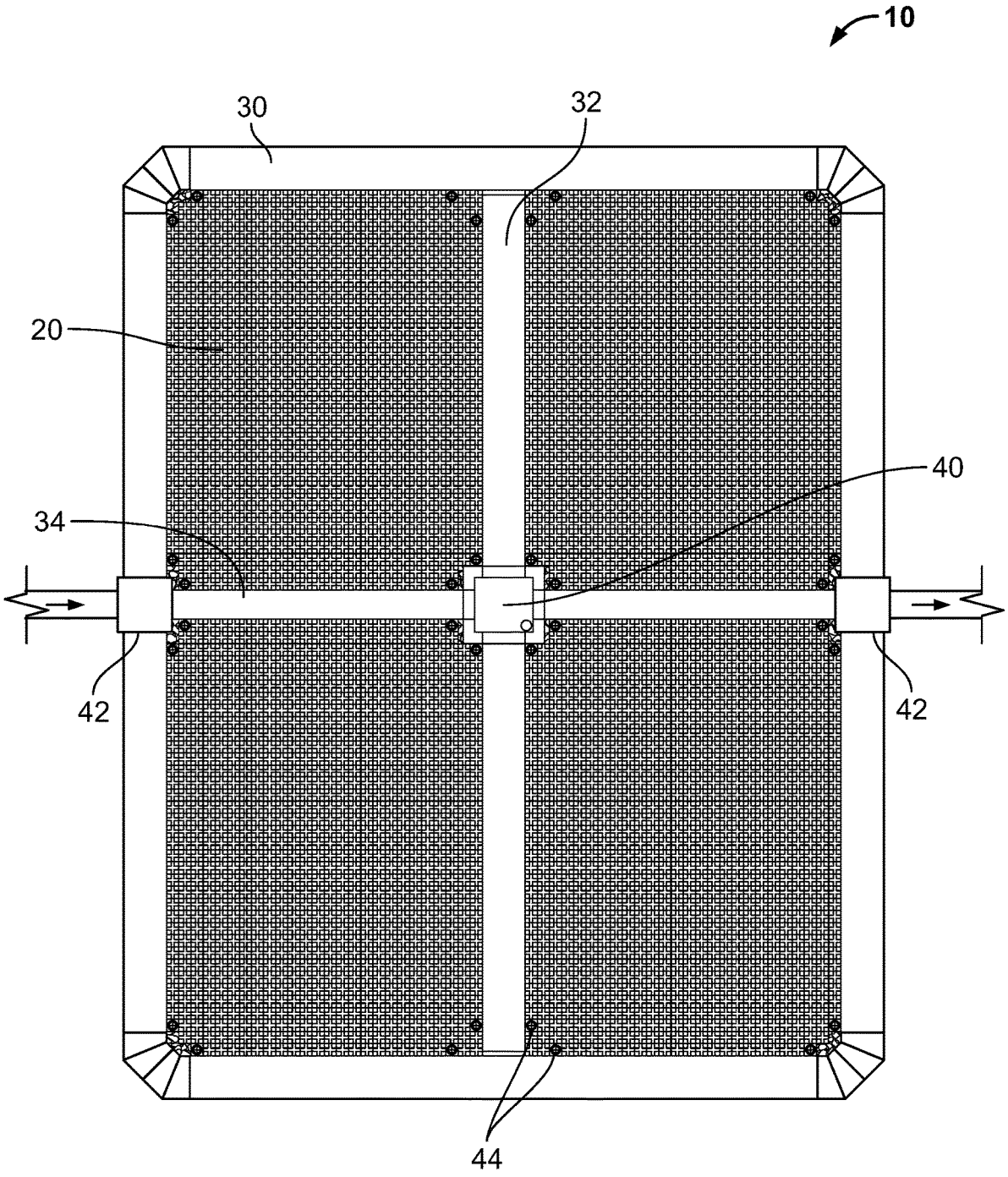
FIG. 3 shows a top view of one embodiment of the present invention.
Figure 4:
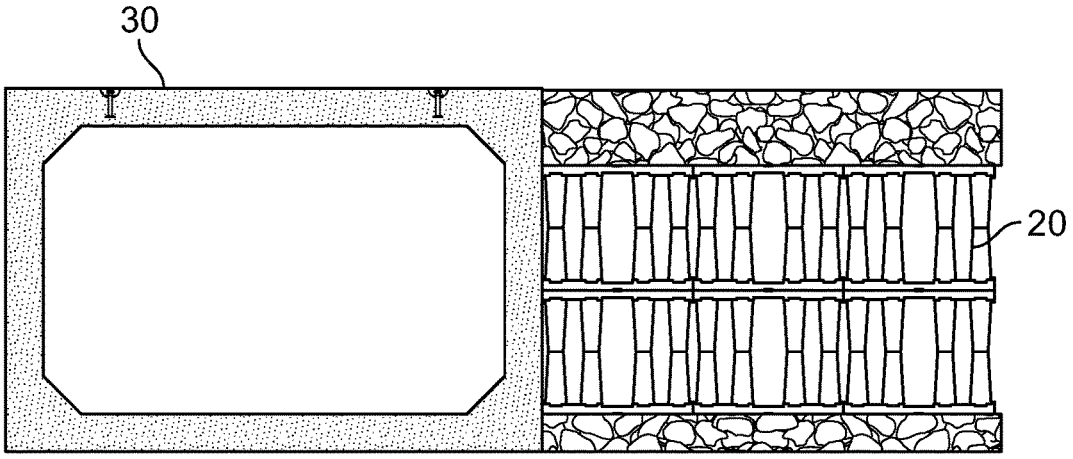
FIG. 4 shows a cross-sectional view of one embodiment of a portion of the present invention.

In the embodiment shown in FIG. 3, there is a singular distribution channel 32 and a singular low flow channel 34. In other embodiments, and within the scope of the invention, are multiple distribution channels 32 parallel to each other and/or multiple low flow channels 34 parallel to each other. This would allow for a variety of configurations of the modular elements 20 within the system 10.

FIG. 3 shows an embodiment having a generally rectangular shape, but other shapes of the system are possible, and would fall within the scope of the invention.

Further, although the embodiment shown in FIG. 3 shows four similarly shaped sections of modular elements 20, it is within the scope of the invention for each section of modular elements 20 to be of differing shapes from one another.

At the intersection point between the low flow channel 34 and the distribution channel 32 is a center access manhole 40. Through the distribution channel 32, this center access manhole 40 allows for easy access to the entirety of system 10, for inspection and cleaning purposes.

In one embodiment, additional access manholes 42 are located at the intersection of at least one of the ends of the low flow channel 34 and the perimeter channel 30. In a preferred embodiment, there would be an additional perimeter manhole 42 at each end of the low flow channel 34.

In one embodiment, the plurality of modular elements 20 includes longitudinal access shafts 44. These can be seen in FIG. 3.

In a preferred embodiment, and as described above, the modular elements 20 are designed with cross shaped inspection channels that allow for two axes of CCTV inspection. The distribution channel 32 and access shafts 44 allow for ease of access to the plurality of modular elements 20. The perimeter of the modular elements 20 is inspected to confirm all connections are operational.

As would be known to a person skilled in the art, all structural components should be inspected for cracking, wearing, and deterioration. All inlets and outlets should be inspected for clogging or blockages.

In a preferred embodiment, the system 10 is designed with a center access manhole 40, perimeter manholes 42, and manhole tees. Thus, the system 10 is human accessible and may be inspected through CCTV or visual inspection.

In one embodiment, sluice gates are incorporated in the center access manhole 40 to isolate sections of system 10 when inspection is required during wet conditions.

Figure 5:
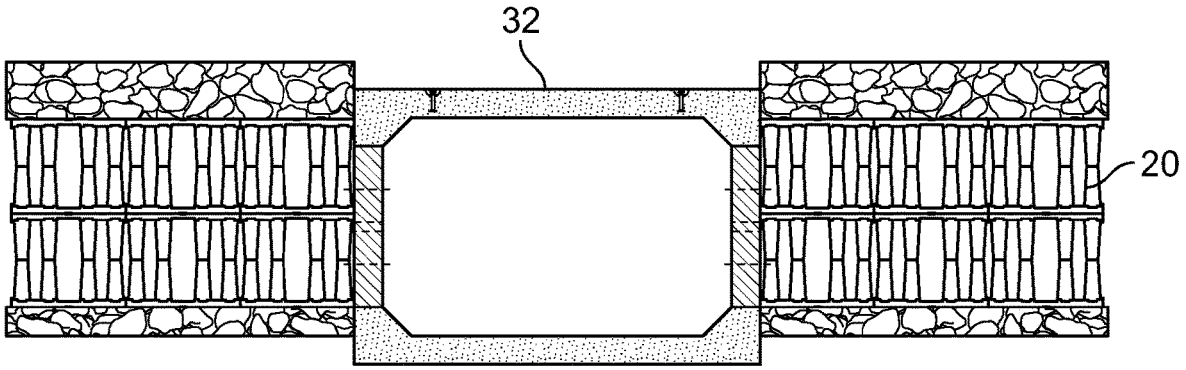
FIG. 5 shows a cross-sectional view of one embodiment of a portion of the present invention.

Referring now to FIG. 5, it can be seen that in one embodiment the distribution channel 32 is positioned lower into the earth than the plurality of modular elements 20. As would be understood by a person skilled in the art, this arrangement allows for water, sediment and debris to collect in this area after the majority of the stored water has been discharged from the storm water system.

Figure 6:
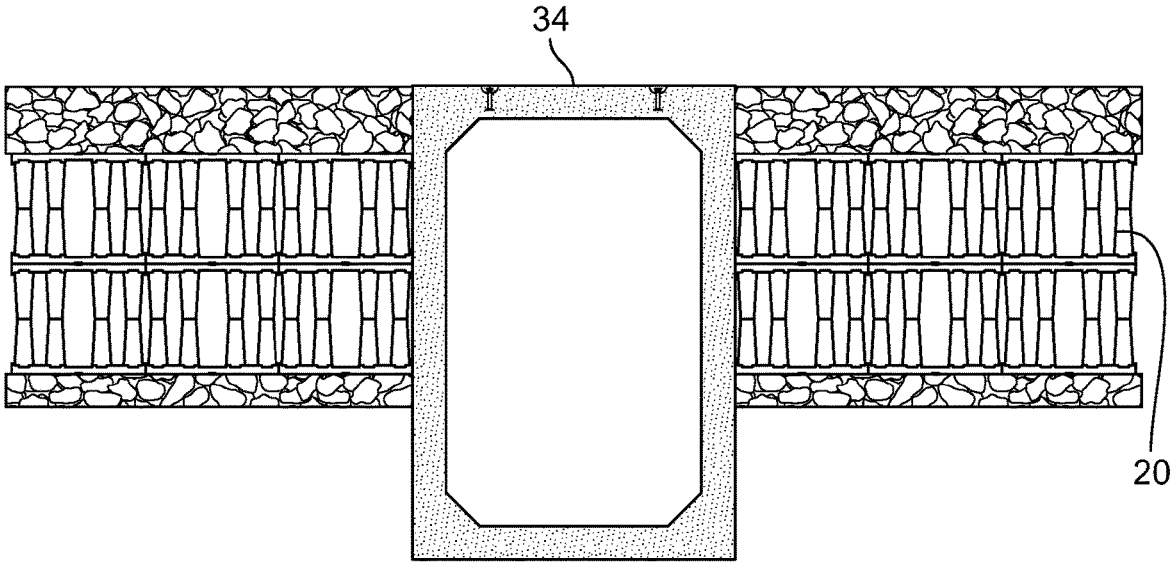
FIG. 6 shows a cross-sectional view of one embodiment of a portion of the present invention.

In one embodiment, as seen in FIG. 6, it can be seen that the low flow channel 34 is positioned even lower into the earth. The low flow channel 34 would be positioned lower than the modular elements 20 and the distribution channel 32, in such a way that the low flow channel 34 would be the primary collection point for sediment and debris.

In another embodiment, the perimeter channel 30 is positioned as the lowest point into the earth. In this embodiment the perimeter channel 30 would be the primary collection point for sediment and debris.

In one embodiment, the system 10 includes access points at critical locations for cleaning. All cleanings may be completed using a high-pressure nozzle 50 on a flushing and vacuum truck (not shown). The center access manhole 40 is the primary collection point for sediment within the system 10.

In one embodiment, during system cleanings, those conducting the cleaning may look to isolate each section of modular elements 20 by engaging the section's respective sluice gate, which, in one embodiment is located on each wall within the centre access manhole 40. The purpose of the sluice gate is to isolate the section being cleaned to omit the risk of backflow from other sections which have yet to be cleaned.

Once each section of modular elements 20 has been thoroughly cleaned, the corresponding sluice gate is to be lifted to avoid obstruction of water flow and maintain the system's function. During maintenance procedures, all sections, other than the one undergoing maintenance, can remain in operation to avoid system surcharge.

Figure 7:
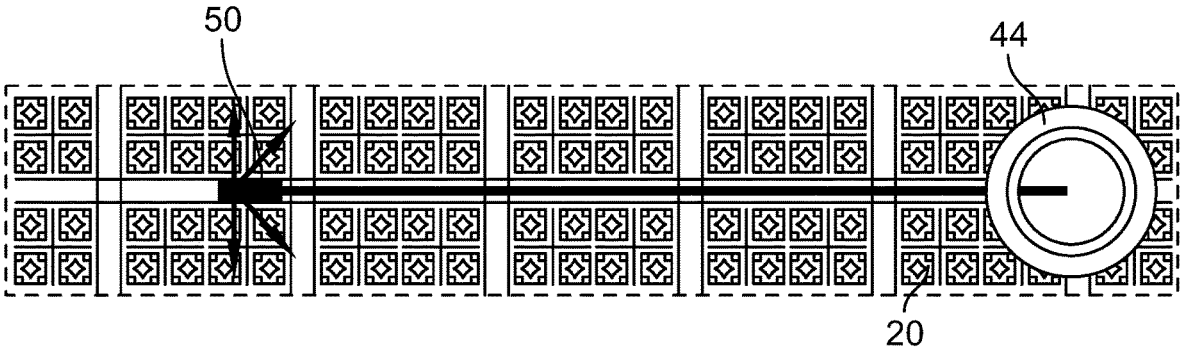
FIG. 7 shows a top view of the cleaning of one embodiment of the present invention.

FIG. 7 shows an embodiment where a pressurized nozzle from a vacuum truck is able to travel throughout the modular elements 20, the perimeter channel 30, the distribution channel 32, and the low flow channel 34 to clean the entire system 10 and vacuum out any sediment and debris.

In another embodiment, a standard sewer camera can travel similarly throughout the modular elements 20, the perimeter channel 30, the distribution channel 32, and the low flow channel 34.

Figure 8:
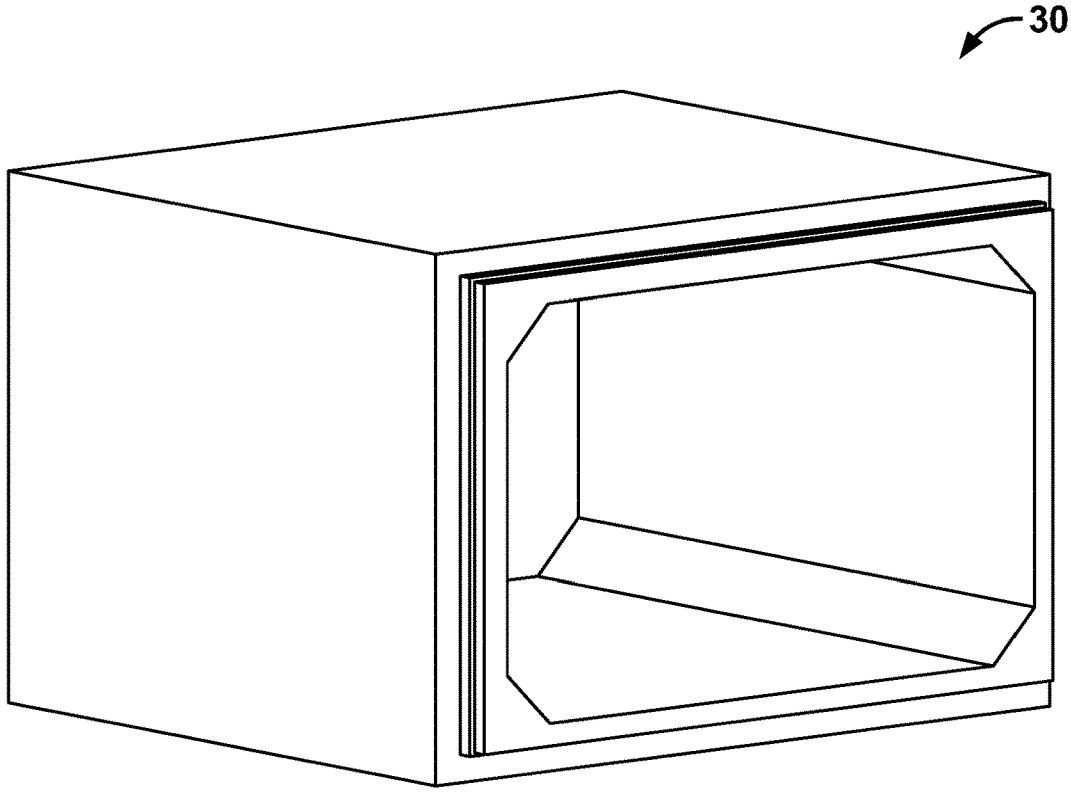
FIG. 8 shows a portion of the perimeter channel of one embodiment of the present invention.

FIG. 8 shows a perspective view of one embodiment of the perimeter channel 30.

Figure 9:
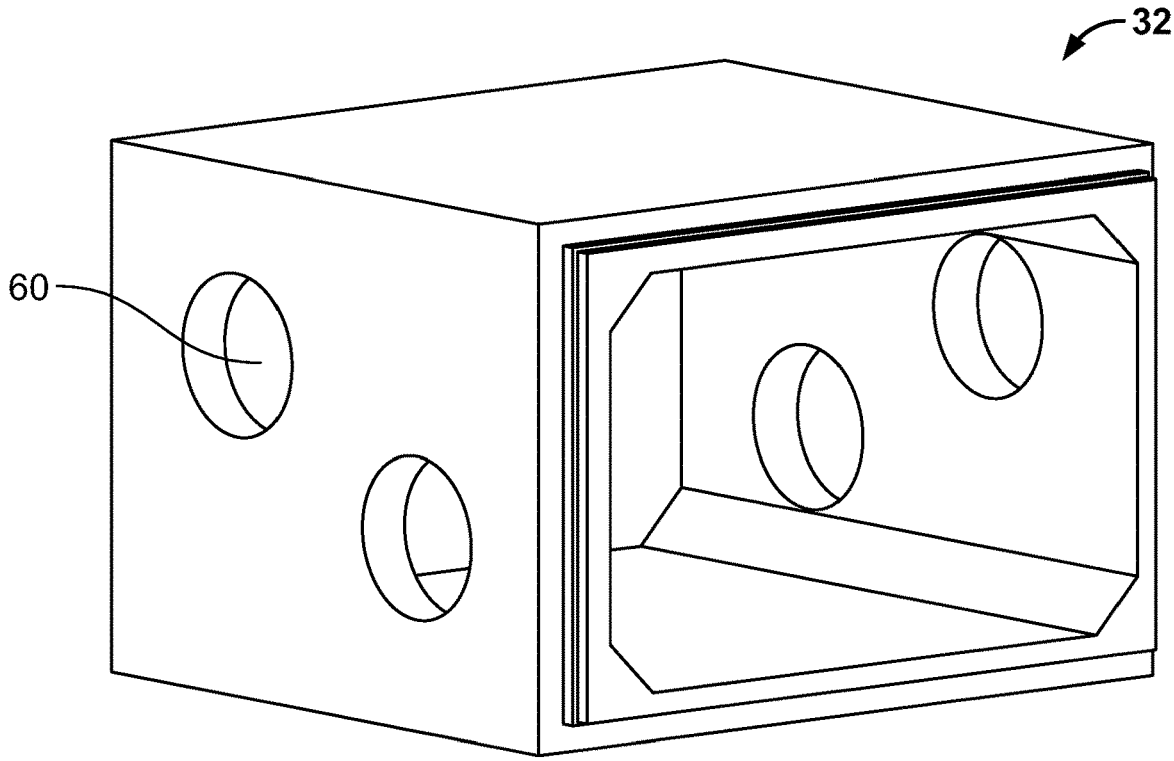
FIG. 9 shows a portion of the distribution channel of one embodiment of the present invention.

FIG. 9 shows one embodiment of a portion of the distribution channel 32, which includes multiple cored-out sections 60 which allow for visual inspection of the modular elements 20, and cleaning access through manned entry (if desired). Varying numbers of the cored-out sections 60 would be within the scope of the invention, as would differing locations of the cored-out sections 60.

In another embodiment, the perimeter channel 30 includes cored-out sections 60. In yet another embodiment, both the perimeter channel 30 and the distribution channel 32 include the cored-out sections 60.

The embodiments described herein are examples of structures, systems or methods having elements corresponding to elements of the techniques of this application. This written description may enable those skilled in the art to make and use embodiments having alternative elements that likewise correspond to the elements of the techniques of this application. The intended scope of the techniques of this application thus includes other structures, systems or methods that do not differ from the techniques of this application as described herein, and further includes other structures, systems or methods with insubstantial differences from the techniques of this application as described herein.

Moreover, the previous detailed description is provided to enable any person skilled in the art to make or use the present invention. Various modifications to those embodiments will be readily apparent to those skilled in the art, and the generic principles defined herein may be applied to other embodiments without departing from the spirit or scope of the invention described herein. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims.

The following discussion provides many example embodiments of the inventive subject matter. Although each embodiment represents a single combination of inventive elements, the inventive subject matter is considered to include all possible combinations of the disclosed elements. Thus, if one embodiment comprises elements A, B, and C, and a second embodiment comprises elements B and D, then the inventive subject matter is also considered to include other remaining combinations of A, B, C, or D, even if not explicitly disclosed.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification or claims refer to at least one of something selected from the group consisting of A, B, C . . . and N, the text should be interpreted as requiring only one element from the group, not A plus N, or B plus N, etc.

The invention claimed is:

1. A stormwater system, comprising:

a plurality of plastic modular elements, each modular element including:

four quadrants, each quadrant having multiple upwardly-extending supports; and a pair of inspection channels arranged in a cross-shape separating the four quadrants;

a distribution channel separating two or more of the plurality of modular elements;

a low flow channel intersecting the distribution channel perpendicularly, and separating two or more of the plurality of modular elements; and a concrete perimeter channel surrounding the plurality of plastic modular elements;

wherein each end of the distribution channel and each end of the low flow channel extend to the perimeter channel.

2. The stormwater system of claim 1, wherein at least one of the distribution channel and the low flow channel is made of concrete.

3. The stormwater system of claim 1, wherein at least one of the perimeter channel, the distribution channel, and the low flow channel is positioned deeper into the ground than the modular elements, thus allowing sediment and debris to collect.

4. The stormwater system of claim 1, further comprising a center access manhole located at the center of the system where the distribution channel intersects with the low flow channel.

5. The stormwater system of claim 1, further comprising additional perimeter manholes at the intersections of the perimeter channel and each end of the low flow channel.

6. The stormwater system of claim 1, wherein at least one of the perimeter channel and the distribution channel includes at least one cored-out section, allowing access to the modular elements.

7. The stormwater system of claim 1, wherein the plurality of modular elements include at least one longitudinal access shaft.

8. The stormwater system of claim 1, wherein at least one additional distribution channel extends perpendicular to the low flow channel and between at least two of the plurality of modular elements.

9. The stormwater system of claim 1, wherein at least one additional low flow channel extends perpendicular to the distribution channel and between at least two of the plurality of modular elements.

10. A stormwater system, comprising:

at least four plastic stormwater sections, each section including at least one inspection channel;

a distribution channel separating two or more of the stormwater sections;

a low flow channel intersecting the distribution channel perpendicularly, and separating two or more of the stormwater sections; and a concrete perimeter channel surrounding the at least four plastic stormwater sections;

wherein each end of the distribution channel and each end of the low flow channel extend to the perimeter channel.

* * * * *